US010138665B2

(12) United States Patent
Hasan et al.

(10) Patent No.: US 10,138,665 B2
(45) Date of Patent: Nov. 27, 2018

(54) ENCLOSURE ASSEMBLY WITH CONCEALED HINGE SYSTEM

(71) Applicant: APPLETON GRP LLC, Rosemont, IL (US)

(72) Inventors: Rehanul Hasan, Waterloo (CA); Neil Andrew Baird, Kitchener (CA); Amit Shirish Kulkarni, Dhayari (IN)

(73) Assignee: Appleton Grp LLC, Rosemont, IL (US)

( * ) Notice: Subject to any disclaimer, the term of this patent is extended or adjusted under 35 U.S.C. 154(b) by 104 days.

(21) Appl. No.: 15/514,250

(22) PCT Filed: Apr. 20, 2016

(86) PCT No.: PCT/IB2016/052233
§ 371 (c)(1),
(2) Date: Mar. 24, 2017

(87) PCT Pub. No.: WO2016/170481
PCT Pub. Date: Oct. 27, 2016

(65) Prior Publication Data

US 2017/0268268 A1 Sep. 21, 2017

(30) Foreign Application Priority Data

Apr. 24, 2015 (IN) ..... 1658/MUM/2015

(51) Int. Cl.
*E05D 7/081* (2006.01)
*E05D 3/02* (2006.01)
(Continued)

(52) U.S. Cl.
CPC ..... *E05D 7/081* (2013.01); *E05D 3/02* (2013.01); *E05D 5/06* (2013.01); *E05D 7/009* (2013.01);
(Continued)

(58) Field of Classification Search
CPC .. E05D 7/081; E05D 7/08; E05D 7/00; E05D 3/02; E05D 3/00; E05D 3/06; E05D 5/06; E05D 5/065; E05D 5/10; E05D 2005/102
(Continued)

(56) References Cited

U.S. PATENT DOCUMENTS 4,390,114 A * 6/1983 Sviatoslavsky ..... F21V 17/12 220/4.02
4,704,970 A * 11/1987 Sanderson ..... E05D 7/14 109/73
(Continued)

OTHER PUBLICATIONS

First Generation pre-2017 Prior Art Hinges.
(Continued)

*Primary Examiner* — Steven A. Reynolds
*Assistant Examiner* — Javier A Pagan
(74) *Attorney, Agent, or Firm* — McDonnell Boehnen Hulbert & Berghoff LLP

(57) ABSTRACT

An enclosure assembly with concealed hinge system comprises a quadrilateral cabinet and a cover that is configured to swivel along a sidewall of the quadrilateral cabinet. The swiveling action of the cover with respect to the quadrilateral cabinet is enabled by the use of a first pair of hinges and at least one second hinge. The first pair of hinges is welded onto the corners of the sidewall, and the at least one second hinge is welded onto the sidewall between the first pair of hinges.

12 Claims, 18 Drawing Sheets

(51) Int. Cl.
*E05D 5/06* (2006.01)
*E05D 7/00* (2006.01)

(52) U.S. Cl.
CPC ..... *E05D 2003/025* (2013.01); *E05Y 2600/41* (2013.01); *E05Y 2900/20* (2013.01); *E05Y 2900/602* (2013.01)

(58) Field of Classification Search
USPC ..... 220/4.02
See application file for complete search history.

(56) References Cited

U.S. PATENT DOCUMENTS 5,259,091 A * 11/1993 Mordick ..... E05D 5/065 16/254
5,722,121 A * 3/1998 Lau ..... E05D 5/128 16/381
5,970,890 A * 10/1999 Harry ..... E05B 65/0075 109/59 R
6,118,073 A * 9/2000 Lau ..... H02B 1/38 174/66
6,185,303 B1 * 2/2001 Losey ..... A47B 96/06 248/219.4
6,321,414 B1 * 11/2001 Buchanan ..... E05D 1/04 16/257
6,438,800 B1 * 8/2002 Narang ..... E05D 7/1005 16/229
6,979,777 B2 * 12/2005 Marcou ..... H02G 3/088 174/50
7,726,750 B2 * 6/2010 Johnson ..... E05B 63/244 312/217
7,761,958 B2 * 7/2010 Alfredsson ..... E05D 7/1061 16/231
2015/0059126 A1 * 3/2015 Dubina ..... E05D 7/00 16/319
2017/0268268 A1 * 9/2017 Hasan ..... E05D 3/02

OTHER PUBLICATIONS

PCT International Search Report and Written Opinion, PCT International Application No. PCT/IB2016/052233, dated Sep. 1, 2016, 8 pages.

* cited by examiner

ENCLOSURE ASSEMBLY WITH CONCEALED HINGE SYSTEM

CROSS REFERENCE TO RELATED APPLICATIONS

The present application is a national stage entry of PCT/IB2016/052233, filed Apr. 20, 2016, which claims priority to Indian Patent Application Serial No. 1658/MUM/2015 filed Apr. 24, 2015, both of which are incorporated herein by reference for all purposes.

FIELD

The present disclosure relates to the field of mechanical engineering. In particular, the present disclosure relates to an enclosure assembly with concealed hinge system.

BACKGROUND

Generally, the conventional enclosure assemblies for electrical systems comprise a cabinet and a cover that is functionally coupled with the cabinet. The cabinet can be made from a metallic material like steel or aluminium, or a non-metallic material like fiber glass or composite glass. Generally, the cabinet has a box-like configuration and is open at one end, which is covered by means of the cover. Conventionally, in a closed configuration, the cover is fastened to the cabinet by means of screws or bolts. One has to unfasten each screw in order open the cover and gain access to the cabinet. The process unfastening all the screws to gain access to the cabinet is cumbersome and time-consuming.

In the conventional enclosure assemblies, the cover is coupled to the cabinet by means of a top hinge and a bottom hinge. These hinges generally protrude out of the enclosure surface and interfere with each other when two or more enclosure assemblies are to be coupled vertically.

Also, the conventional enclosure assemblies involve fixing of a plurality mounting feet on the enclosure assembly to facilitate the mounting of the enclosure assembly. These mounting feet are generally coupled to the enclosure assemblies by means of screws or bolts. These screws or bolts tend to bend for heavier enclosure assemblies, which is not desirable as the enclosure assembly faces the risk of accidental dismounting owing to the failure of the screws or the bolts.

Furthermore, some conventional hinges and mounting feet involve the use of press-fit inserts to facilitate their mounting onto the enclosure assemblies. The usage of these inserts allows the leakage of water inside the cabinet and loosening of components over a period of time. Also, the conventional enclosure assemblies face handling difficulties during shipment due to the lack of mounting provisions for the mounting of the lifting eye.

Hence, there is need for an enclosure assembly with concealed hinge systems that overcomes the above mentioned drawbacks associated with the conventional enclosure assemblies.

OBJECTS

Some of the objects of the present disclosure, which at least one embodiment herein satisfies are as follows.

It is an object of the present disclosure to ameliorate one or more problems of the conventional practices or to at least provide a useful alternative.

An object of the present disclosure is to provide an enclosure assembly with a concealed hinge system.

Another object of the present disclosure is to provide an enclosure assembly with a concealed hinge system that does not involve the use of press fit inserts.

Yet another object of the present disclosure is to provide an enclosure assembly with a concealed hinge system that has mounting provisions for mounting a lifting eye for handling the enclosure assemblies during shipment.

Still another object of the present disclosure is to provide an enclosure assembly with a concealed hinge system such that the vertical coupling of two or more enclosure assemblies does not cause interference of the hinges between two adjacent enclosure assemblies.

Other objects and advantages of the present disclosure will be more apparent from the following description when read in conjunction with the accompanying figure, which are not intended to limit the scope of the present disclosure.

SUMMARY

The present disclosure envisages an enclosure assembly with a concealed hinge system that comprises a quadrilateral cabinet and a cover. The quadrilateral cabinet is defined by a base and sidewalls extending from the base, wherein the sidewalls define a coplanar rim. The coplanar rim has four corners. The quadrilateral cabinet further defines a hollow space. The cover is configured to swivel along a first sidewall to tightly seal the hollow space. The enclosure assembly further comprises a first pair of hinges defined by brackets welded to a first corner and a second corner of the first sidewall. The brackets are defined by a first footplate and an integral ear extending from the first footplate. A recessed aperture is defined in the integral ear. A block is welded to an inner surface of the cover having a tapped blind hole defined therein. In an operative configuration, the tapped bling hole is coaxial with the recessed aperture defined in the integral ear. The enclosure assembly further comprises a threaded fixture adapted to pass through the recessed aperture and thread into the tapped blind hole. The threaded fixture has a head complementary to the recessed aperture. The enclosure assembly further comprises at least one second hinge having a second footplate welded to the rim of the first sidewall. Arcuate arms extend from the either end of the second footplate wherein the arcuate arms define coaxial apertures. The enclosure assembly further comprises a sleeve weldable to the inner surface of the cover defining a through-hole. A pin is configured to pass through the coaxial apertures and the through-hole. In an operative configuration, the recessed apertures in the first pair of hinges, the tapped blind hole, the coaxial apertures defined in the arcuate arms, and the through-hole are coaxial to enable the swiveling action of the cover over second, third, and fourth sidewalls to enclose the hollow space defined in the quadrilateral cabinet.

BRIEF DESCRIPTION OF ACCOMPANYING FIGURES

An enclosure assembly with a concealed hinge system will now be described with the help of the accompanying drawings in which.

DETAILED DESCRIPTION

An enclosure assembly with a concealed hinge system in accordance with an embodiment of the present disclosure will now be described with reference to the embodiments, which do not limit the scope and ambit of the disclosure. The description provided is purely by way of example and illustration. The embodiment herein, the various features, and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced, and to further enable those of skill in the art to practice the embodiments herein. Accordingly, the examples should not be construed as limiting the scope of the embodiments herein.

Figure 1:
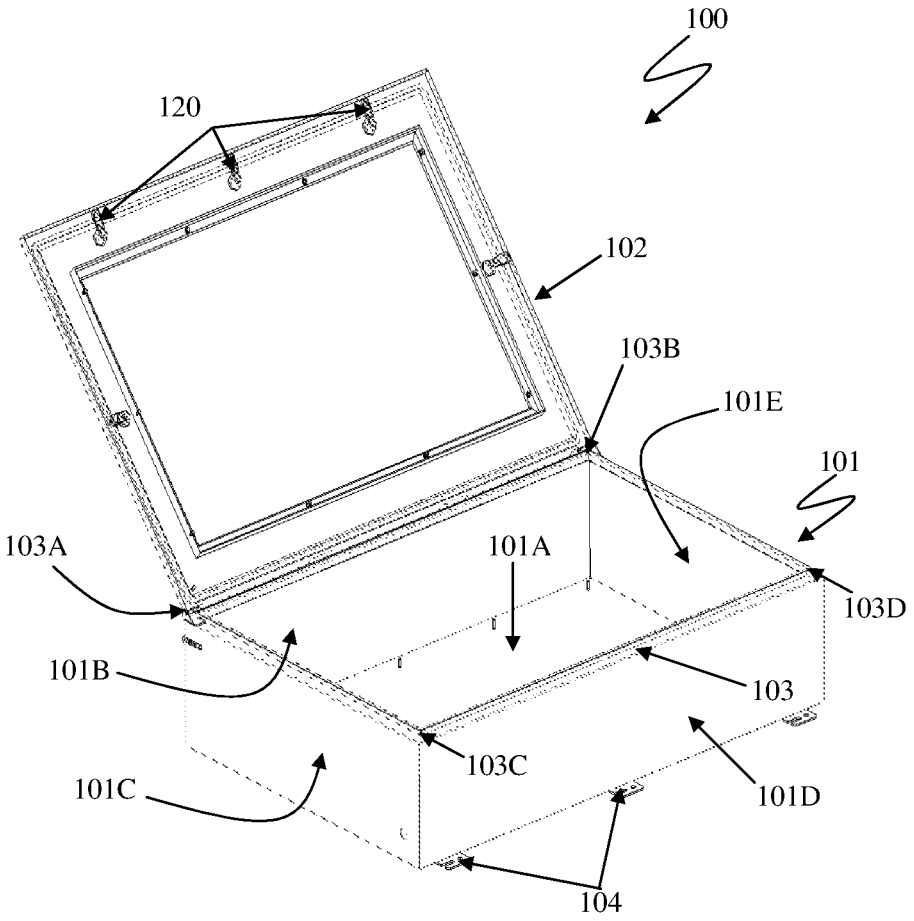
FIG. 1 illustrates an isometric view of an enclosure assembly with a concealed hinge system, in accordance with an embodiment of the present disclosure.

FIG. 1 illustrates an isometric view of an enclosure assembly with a concealed hinge system (hereinafter referred to as enclosure assembly 100), in accordance with an embodiment of the present disclosure. As seen in FIG. 1, the enclosure assembly 100 comprises a quadrilateral cabinet 101 and a cover 102 that is hingeably coupled to the quadrilateral cabinet 101. The quadrilateral cabinet 101 has a base 101A and a first sidewall 101B, a second sidewall 101C, a third sidewall 101D,v and a fourth sidewall 101E extending from the base 101A, thereby defining a hollow space. The sidewalls 101B, 101C, 101D and 101E define a coplanar rim 103 having four corners, viz., a first corner 103A, a second corner 103B, a third corner 103C, and a fourth corner 103D. The cover 102 is configured to swivel along the first sidewall 101B of the quadrilateral cabinet 101. The enclosure assembly 100 further comprises a plurality mounting feet 104 that facilitates the mounting of the enclosure assembly 100. The enclosure assembly also comprises a plurality of latches 120 that facilitate the fastening of the cover 102 with the quadrilateral cabinet 101. In an embodiment, the enclosure assembly 100 may be made from a metallic material like stainless steel to provide a corrosion resistant enclosure. In another embodiment, the enclosure assembly 100 may also be made from a non-metallic material like polypropylene, high density polyethylene, and the like.

Figure 2A:
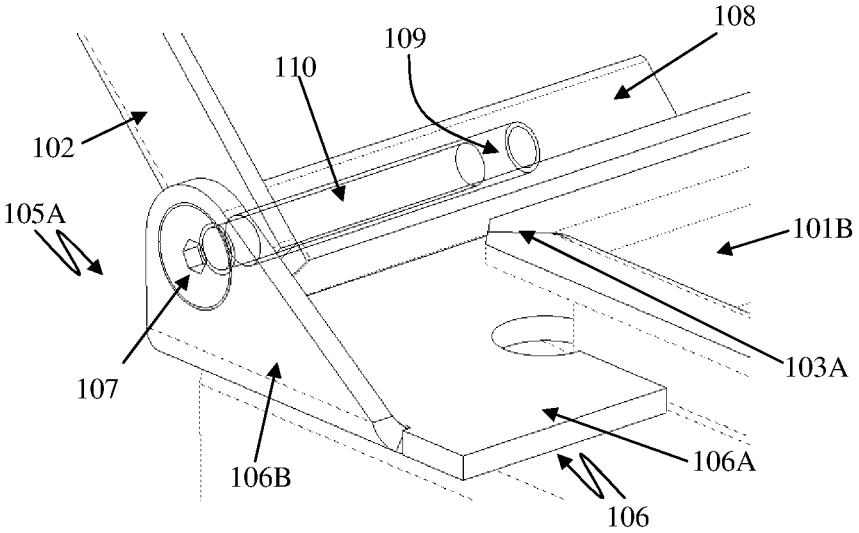
FIG. 2A and FIG. 2B illustrate isometric views of a hinge from the first pair of hinges used in the enclosure assembly of FIG. 1.
Figure 2B:
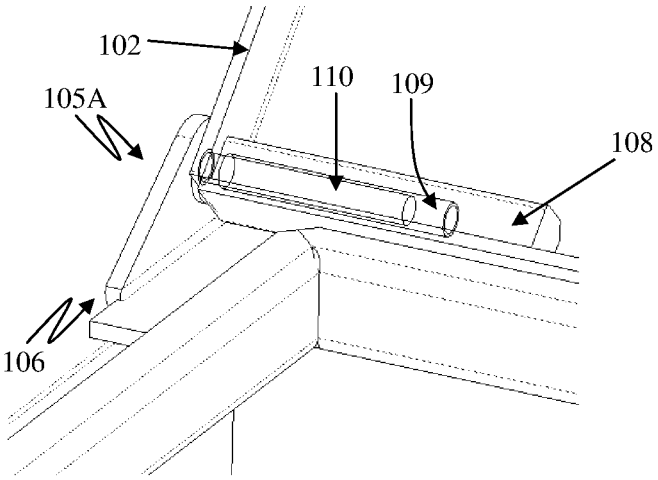
Figure 2C:
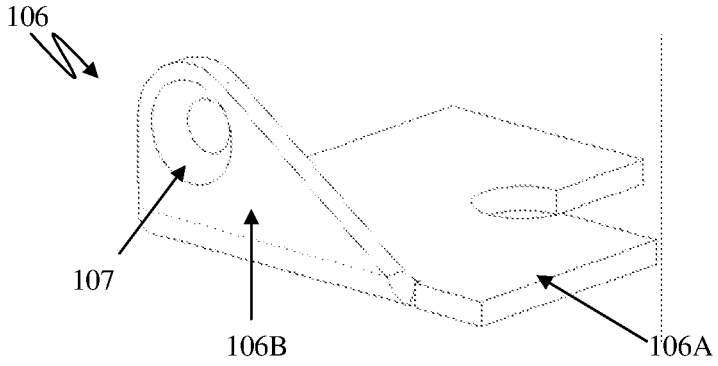
FIG. 2C illustrates an isometric view of a bracket of the hinge of FIG. 2A and 2B.

The enclosure assembly 100 further comprises a first pair of hinges 105A, 105B. FIG. 2A to FIG. 2C illustrate the different views of a first hinge 105A of the first pair of hinges 105A, 105B. The first hinge 105A is defined by a bracket 106 that is welded to the first corner 103A of the first sidewall 101B. The bracket 106 is defined by a first footplate 106A and an integral ear 106B extending from the first footplate 106A. As seen in FIG. 2C, a recessed aperture 107 is defined on the integral ear 106B. In an embodiment, the recessed aperture 107 may be a countersunk hole.

Figure 2D:
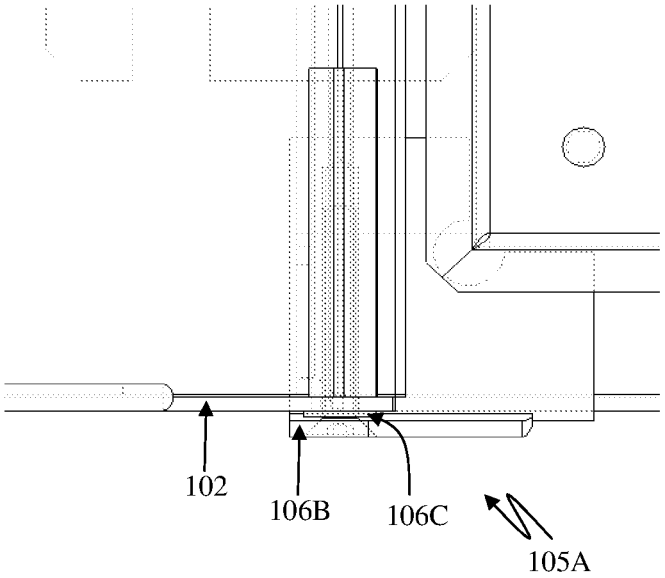
FIG. 2D illustrates a top view of a bracket of the hinge of FIG. 2A and 2B.

With reference to FIG. 2A, FIG. 2B, and FIG. 2C, the enclosure assembly 100 further comprises blocks 108 welded to an inner surface of the cover 102. A tapped blind hole 109 is defined in the block 108. The block 108 is disposed on the inner surface of the cover 102, such that in an operative configuration, the tapped blind hole 109 is coaxially registered with the recessed aperture 107 defined on the integral ear 106B. A threaded fixture 110 is adapted to pass through the recessed aperture 107 and thread into the tapped blind hole 109. In an embodiment, the threaded fixture may be a screw. In yet another embodiment, the threaded fixture may be a countersunk screw having a head complementary to the recessed aperture 107 that has a profile of a countersunk hole, such that subsequent to the assembly, the head of the threaded fixture does not protrude out of the recessed aperture 107. In the embodiment seen in FIG. 2D, a seal of a material like nylon, is disposed operatively between the integral ear 106B and the cover 102 to prevent the direct surface contact of the integral ear 106B and the cover 102, thereby reducing friction.

In a manner similar to that described in the previous paragraphs, the second hinge 105B of the first pair of hinges 105A, 105B, another block 108, and another threaded fixture 110 are also configured near the second corner 103B of the first sidewall 101B. Thus, the first hinge 105A and the second hinge 105B of the first pair of hinges 105A, 105B, the blocks 108, and threaded fixtures 110 enable the swiveling action of the cover 102 with respect to the quadrilateral cabinet 101.

Figure 3A:
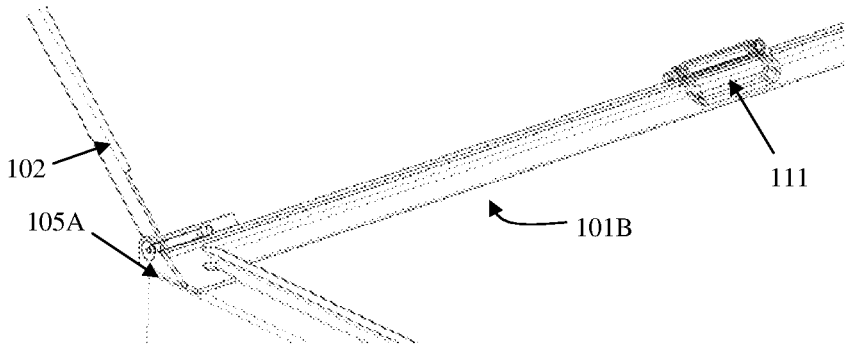
FIG. 3A illustrates an isometric view of a second hinge used in the enclosure assembly of FIG. 1.
Figure 3B:
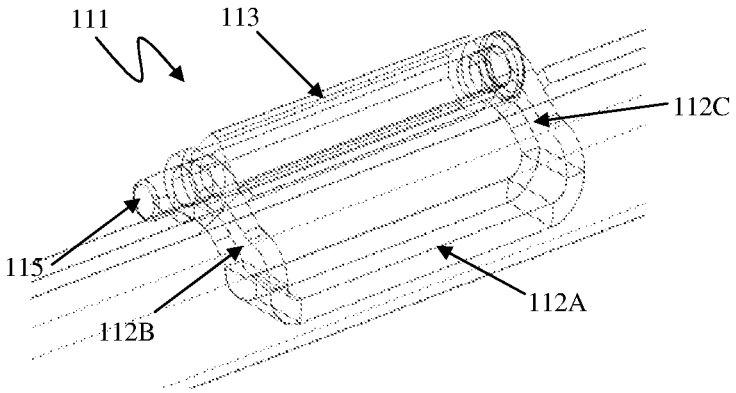
FIG. 3B illustrates another isometric view of the second hinge used in the enclosure assembly of FIG. 1.
Figure 3C:
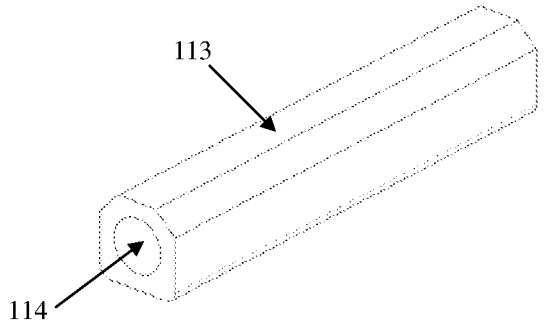
FIG. 3C illustrates an isometric view of a sleeve used in the second hinge of FIG. 3B.
Figure 3D:
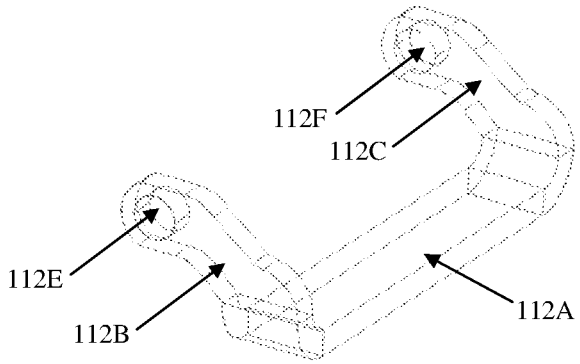
FIG. 3D illustrates an isometric view of the bracket used in the second hinge of FIG. 3C.
Figure 3E:
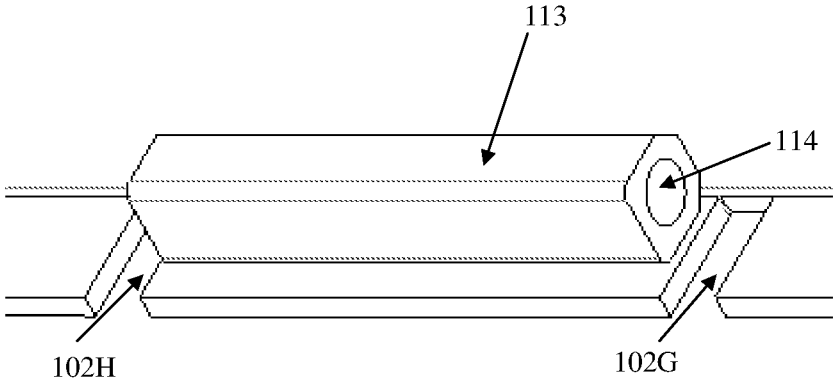
FIG. 3E illustrates another isometric view of the sleeve of FIG. 3B.

The enclosure assembly 100 further comprises one or more second hinge 111 operatively disposed along the coplanar rim 103 of the first sidewall 101B, between the first pair of hinges 105A, 105B. FIG. 3A and FIG. 3B illustrate the isometric views of the second hinge 111. FIG. 3C to FIG. 3E illustrate different views of the various elements associated with the second hinge. The second hinges 111 provide structural integrity and enhanced swiveling action to the hingeable coupling of the cover and the quadrilateral cabinet. With reference to FIG. 3A to FIG. 3E, the second hinge 111 is defined by a second footplate 112A welded to the coplanar rim 103 on the first sidewall 101B. The second hinge 111 also has arcuate arms 112B, 112C extending from the second footplate 112A. Coaxial apertures 112E, 112F are defined in the arcuate arms 112B, 112C. The enclosure assembly further comprises a sleeve 113 that is weldable to the inner surface of the cover 102. A through-hole 114 is defined in the sleeve 113. The sleeve 113 is disposed on the inner surface of the cover 102, such that the through-hole 114 defined in the sleeve 113 and the coaxial apertures 112E, 112F defined on the arcuate arms 112B, 112C are coaxially registered in an operative configuration. Two slots 102G, 102H are configured on the cover 102 adjacent to the operative ends of the sleeve 113 to accommodate the arcuate arms 112B, 112C of the second hinge 111. Thus, in an operative configuration, the arcuate arms 112B, 112C do not interfere with the swiveling action of the cover 102, and the second hinges 111 are concealed within the enclosure assembly. More specifically, the second hinge 111 does not protrude out of the enclosure assembly surface. A pin 115 is adapted to pass through the coaxial apertures 112E, 112F and the through-hole 114 in the operative configuration. In the operative configuration, said recessed apertures 107 in the first pair of hinges 105A, 105B, the tapped blind hole 109 defined in the blocks 108, the coaxial apertures 112E, 112F defined in the arcuate arms 112B, 112C, and the through-holes 114 are coaxial to enable the swiveling action of the cover 102 over the second, third, and fourth sidewalls to enclose the hollow space defined in the quadrilateral cabinet.

Figure 4A:
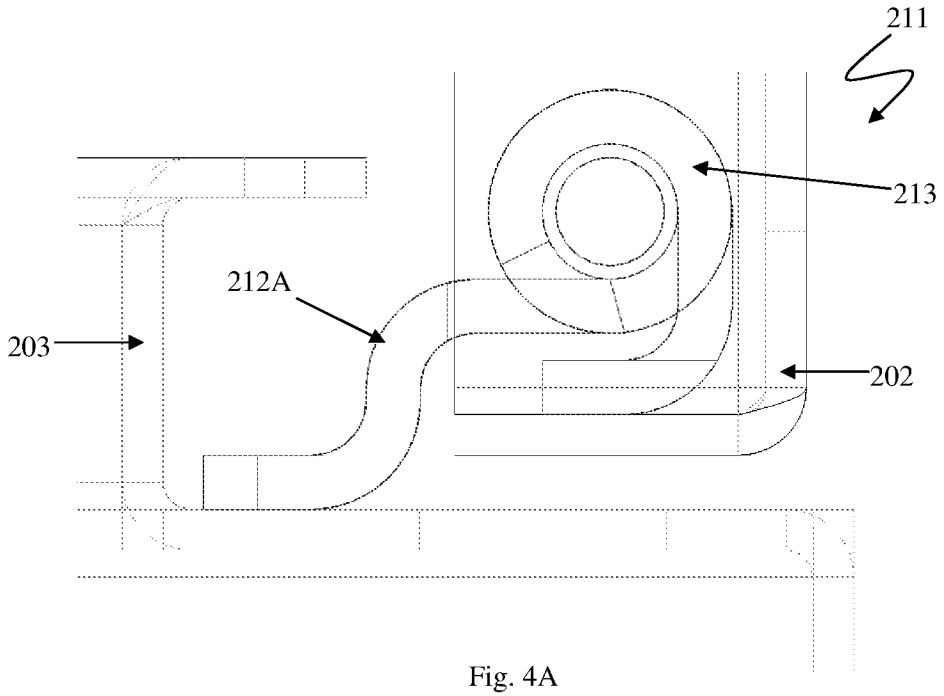
FIG. 4A and FIG. 4B illustrate a sectional view and an isometric view, respectively, of a second hinge in accordance with another embodiment of the present disclosure.
Figure 4B:
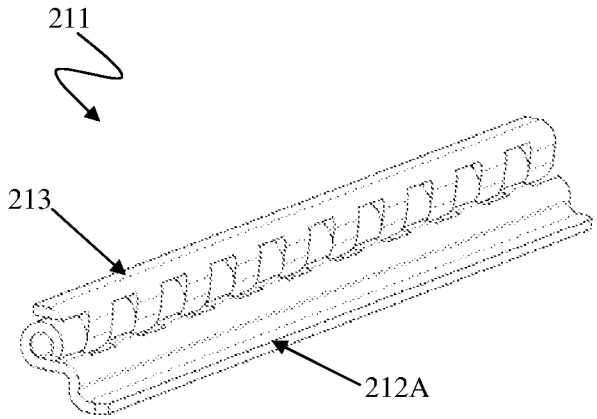

FIG. 4A and FIG. 4B illustrate a sectional view and an isometric view of a second hinge 211 respectively, in accordance with another embodiment of the present disclosure. Referring to FIG. 4A and FIG. 4B, the second footplate 212A, which is secured on the coplanar rim 203, defines a first plurality of knuckles. The sleeve 213, which is secured on the inner surface of the cover 202, defines a second plurality of knuckles that has a profile complementary to the first plurality of knuckles. In an operative configuration, the first plurality of knuckles and the second plurality of knuckles are coaxially registered, and a pin is inserted therein to hingeably couple the second footplate 212A with the sleeve 213.

Figure 5A:
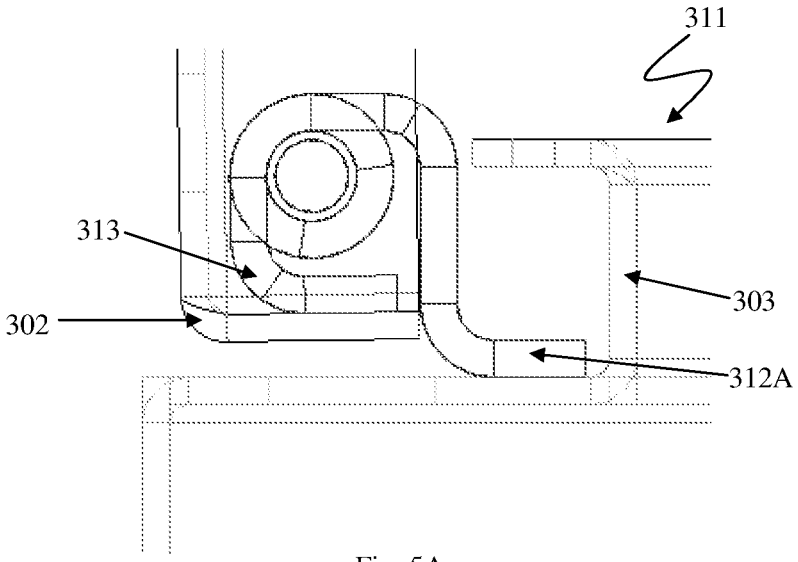
FIG. 5A and FIG. 5B illustrate a sectional view and an isometric view, respectively, of a second hinge in accordance with another embodiment of the present disclosure.
Figure 5B:
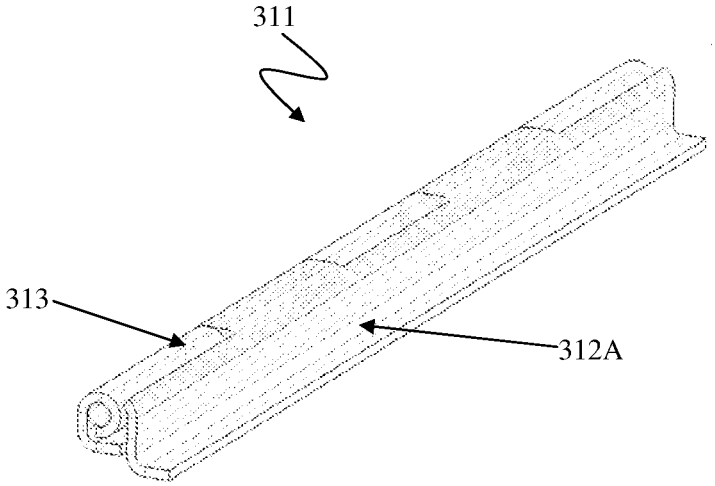

FIG. 5A and FIG. 5B illustrate a sectional view and an isometric view of a second hinge 311 respectively, in accordance with another embodiment of the present disclosure. Referring to FIG. 5A and FIG. 5B, the second footplate 312A, which is secured on the coplanar rim 303, defines a first plurality of knuckles. The sleeve 313, which is secured on the inner surface of the cover 302, defines a second plurality of knuckles that has a profile complementary to the first plurality of knuckles. In an operative configuration, the first plurality of knuckles and the second plurality of knuckles are coaxially registered, and a pin is inserted therein to hingeably couple the second footplate 312A with the sleeve 313.

Figure 6A:
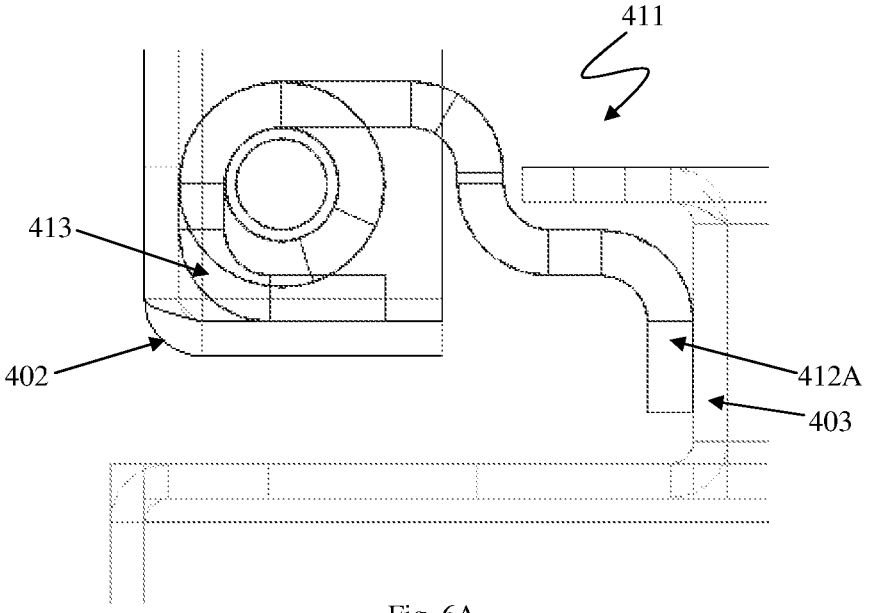
FIG. 6A and FIG. 6B illustrate a sectional view and an isometric view, respectively, of a second hinge in accordance with another embodiment of the present disclosure.
Figure 6B:
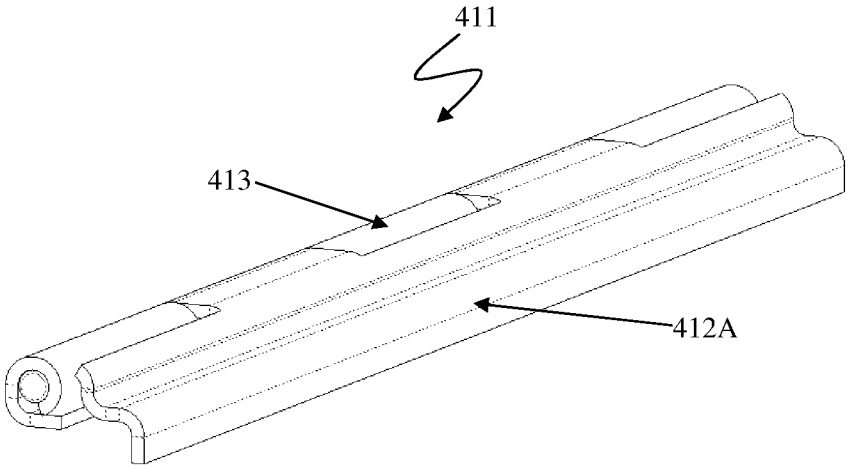

FIG. 6A and FIG. 6B illustrate a sectional view and an isometric view of a second hinge 411 respectively, in accordance with another embodiment of the present disclosure. Referring to FIG. 6A and FIG. 6B, the second footplate 412A, which is secured on the coplanar rim 403, defines a first plurality of knuckles. The sleeve 413, which is disposed on the inner surface of the cover 402, defines a second plurality of knuckles that has a profile complementary to the first plurality of knuckles. In an operative configuration, the first plurality of knuckles and the second plurality of knuckles are coaxially registered, and a pin is inserted therein to hingeably couple the second footplate 412A with the sleeve 413.

Figure 7A:
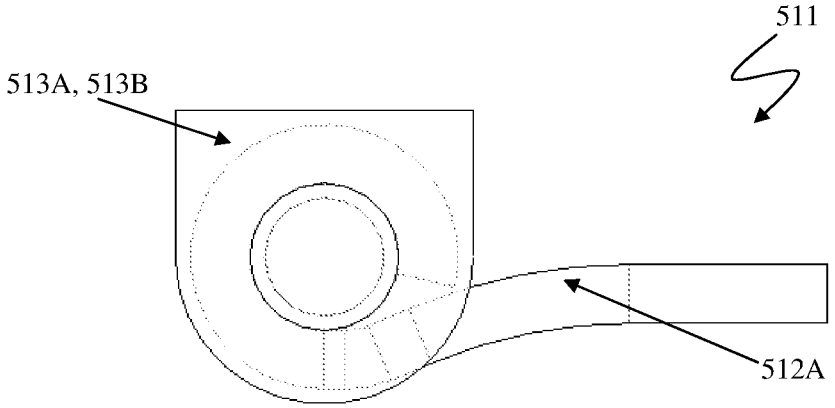
FIG. 7A and FIG. 7B illustrate a sectional view and an isometric view, respectively, of a second hinge in accordance with another embodiment of the present disclosure.
Figure 7B:
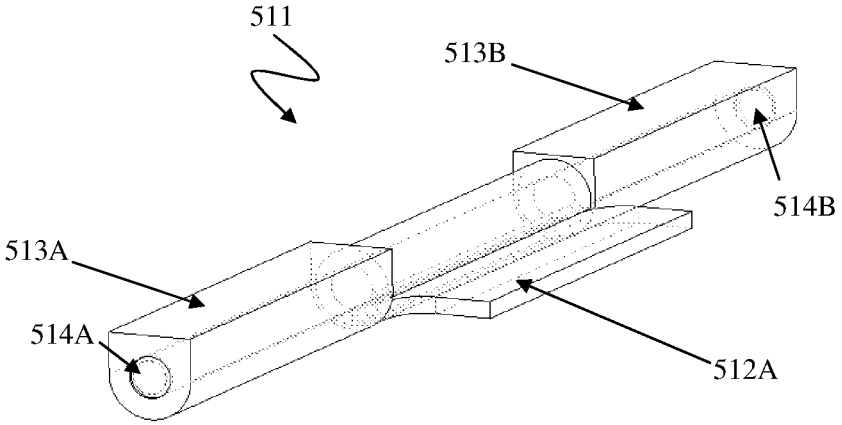

FIG. 7A and FIG. 7B illustrate a sectional view and an isometric view of a second hinge 511 respectively, in accordance with another embodiment of the present disclosure. In this embodiment, there are two sleeves 513A, 513B secured to the inner surface of the cover. Each sleeve 513A, 513B has a through-hole 514A, 514B formed therein. The second footplate 512A, which is secured on the coplanar rim, defines a knuckle. In an operative configuration, the knuckle and the through-holes 514A, 514B are coaxially registered and a pin is inserted therein to hingeably couple the second footplate 512A with the sleeves 513A, 513B.

Figure 8A:
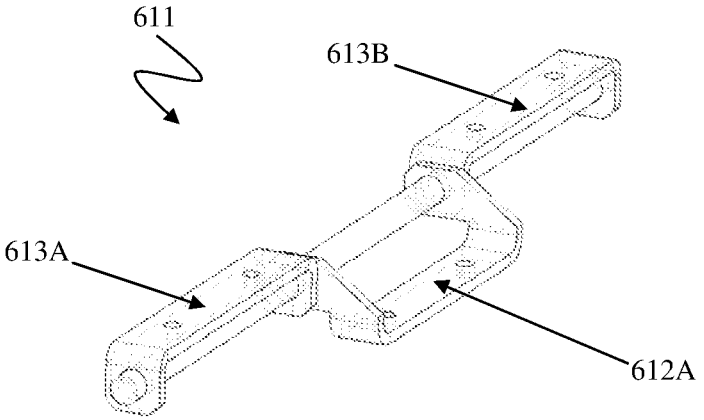
FIG. 8A illustrates an isometric view of a second hinge in accordance with another embodiment of the present disclosure.
Figure 8B:
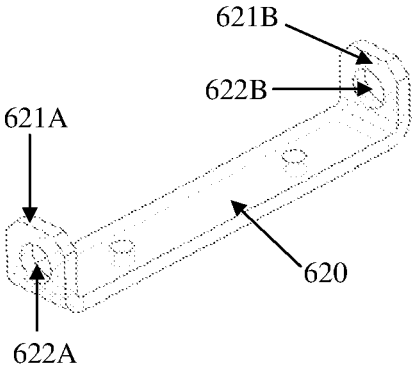
FIG. 8B illustrates an isometric view of a bracket, that is to be mounted on the cover, used in the second hinge of FIG. 8A.
Figure 8C:
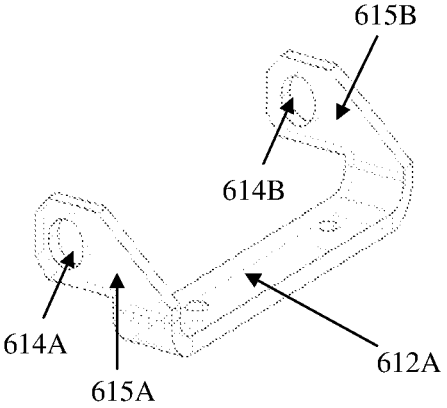
FIG. 8C illustrates an isometric view of a bracket, that is to be mounted on quadrilateral cabinet, used in the second hinge of FIG. 8A.

FIG. 8A illustrates an isometric view of a second hinge in accordance with another embodiment of the present disclosure. FIG. 8B illustrates an isometric view of a bracket, which is to be mounted on the cover, used in the second hinge of FIG. 8A. FIG. 8C illustrates an isometric view of a bracket, which is to be mounted on quadrilateral cabinet, used in the second hinge of FIG. 8A. In this embodiment, the sleeves are replaced by brackets 613A, 613B and are secured to the inner surface of the cover. Each bracket 613A, 613B has a base 620 and arms 621A, 621B extending from the base 620. Coaxial apertures 622A, 622B are configured on the arms 621A, 621B. The second footplate 612A has a pair of extended arms 615A, 615B extending therefrom. Coaxial holes 614A, 614B are defined on the extended arms 615A, 615B. In an operative configuration, coaxial apertures 622A, 622B and the coaxial holes 614A, 614B are coaxially registered and a pin is inserted therein to hingeably couple the second footplate 612A with the brackets 613A, 613B.

Figure 9A:
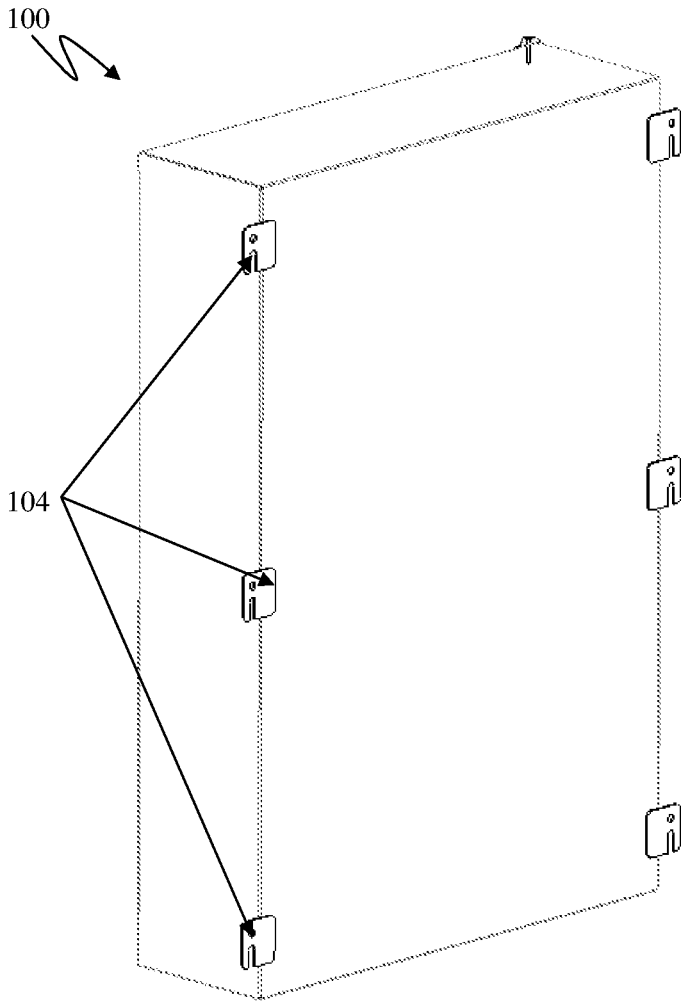
FIG. 9A illustrates another isometric view of the enclosure assembly of FIG. 1.
Figure 9B:
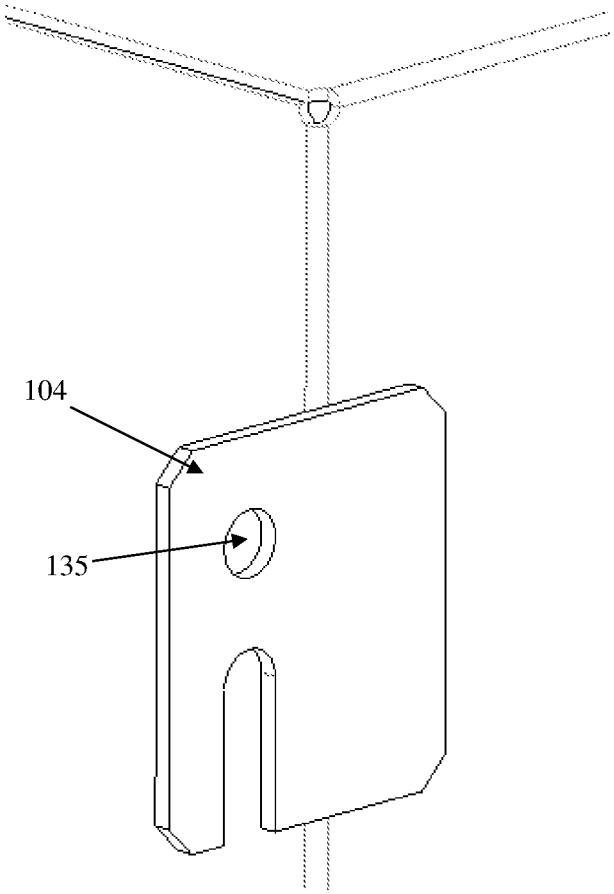
FIG. 9B illustrates an isometric view of a mounting feet used in the enclosure assembly of FIG. 9A.

FIG. 9A illustrates an isometric view of the enclosure assembly 100 that depicts the configuration of the plurality of mounting feet 104 onto the enclosure assembly 100. FIG. 9B illustrates an isometric view of the mounting feet 104. The plurality of mounting feet 104 is welded onto the enclosure assembly 100. As such, the use of the fasteners like screws or bolts is avoided, thereby preventing the accidental dismounting of the enclosure assembly 100 owing to the failure of the fasteners. Also, a hole 135 configured on the mounting feet 104 facilitates the mounting of the lifting eye for the purpose of handling during shipping.

The enclosure assembly 100 of the present disclosure does not involve the use of press-fit inserts for the mounting of hinges or the mounting feet. Also, as explained previously, since the second hinges 111 are concealed within the enclosure assembly 100 and do not protrude out of the enclosure assembly surface, the vertical coupling of enclosures is possible, since the hinges do not interfere with each other, as opposed to the conventional enclosure assemblies.

The use of latches 120 enables convenient and easy fastening and unfastening of the cover 102 with the quadrilateral cabinet 101, unlike the conventional enclosure assemblies, where the fastening of the cover with the cabinet is achieved by use of fasteners and the user has to unfasten each and every screw to gain access to the cabinet.

Also, the covers of the larger-sized conventional enclosure assembly were prone to bow at the centre due to flimsiness. The cover 102 of the present enclosure assembly 100 of the present disclosure may be adapted to receive reinforcing elements on the inner surface of the cover 102 to enhance the structural integrity thereof.

Figure 10A:
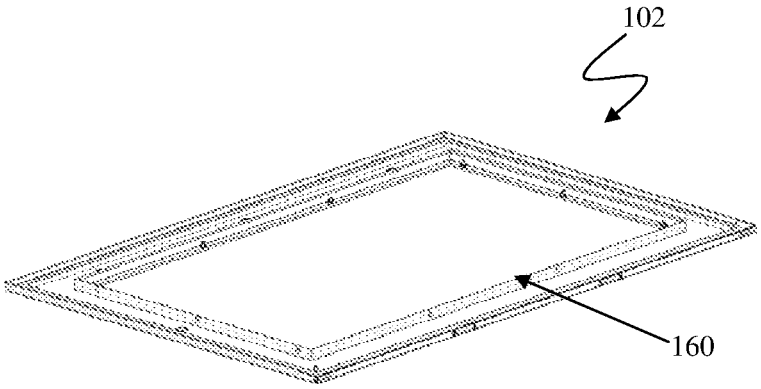
FIG. 10A and FIG. 10B illustrate isometric views of the cover having a reinforcing element configured on inner surface of the cover, in accordance with an embodiment of the present disclosure.
Figure 10B:
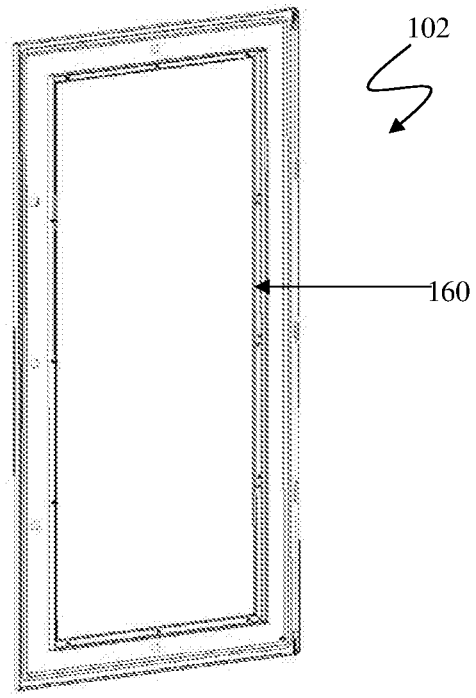

FIG. 10A and FIG. 10B illustrate isometric views of the cover 102. As seen in FIG. 10A, a reinforcing element in the form of a reinforcing frame 160 is secured on the inner surface of the cover 102. The reinforcing frame 160 may either be welded or fastened to the inner surface of the cover 102. The fastening of the reinforcing frame 160 on the inner surface of the cover 102 may be done either by means of studs or screws. The reinforcing frame 160 of the present embodiment has a rectangular configuration. In yet another embodiment, the reinforcing frame 160 may have an L-shape cross-section, a C-shape cross-section, unistrut cross-section, a square cross-section, and the like.

Figure 11:
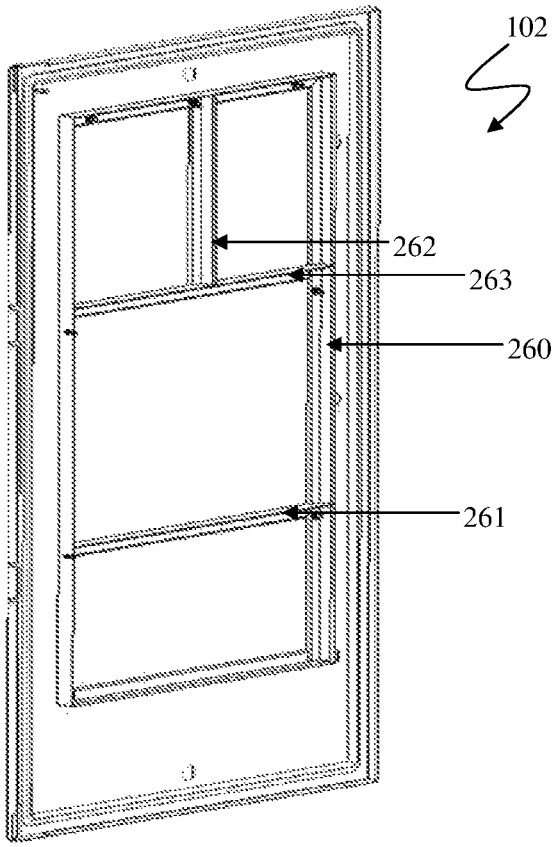
FIG. 11 illustrates an isometric view of the cover having a reinforcing element configured on inner surface of the cover, in accordance with another embodiment of the present disclosure.

FIG. 11 illustrates an isometric cover 102 having a reinforcing element configured on inner surface of the cover 102, in accordance with another embodiment of the present disclosure. The reinforcing element in the present embodiment is a reinforcing frame 260. The reinforcing frame 260 comprises cross members 261, 262, 263 to enhance the structural integrity of the cover 102. The number of the cross members is not limited to three, and the reinforcing frame 260 may have any number of cross members arranged in any configuration other than that illustrated in FIG. 11. In yet another embodiment, the reinforcing frame 260 and the cross members 261, 262, 263 may have an L-shape cross-section, a C-shape cross-section, unistrut cross-section, a square cross-section, and the like. Furthermore, the reinforcing frame 260 may either be welded or fastened to the inner surface of the cover 102. The fastening of the reinforcing frame 260 on the inner surface of the cover 102 may be done either by means of studs or screws.

Figure 12:
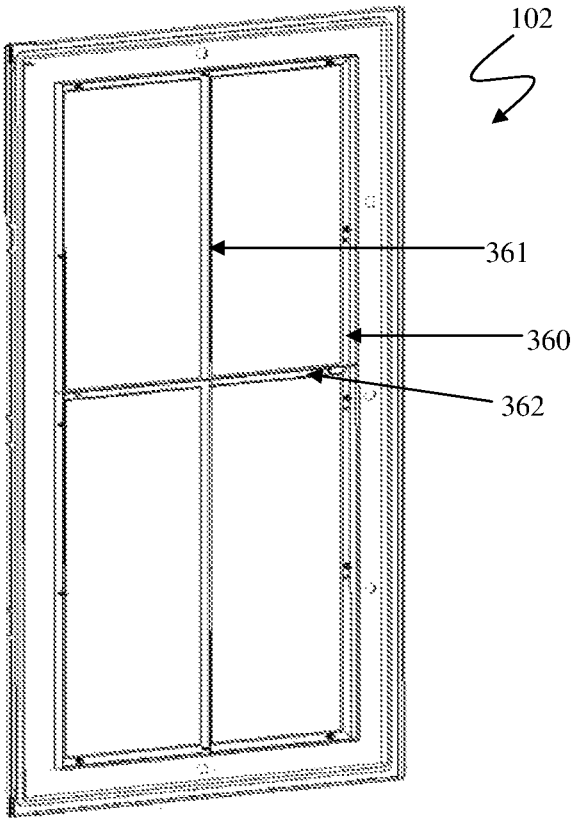
FIG. 12 illustrates an isometric view of the cover having a reinforcing element configured on inner surface of the cover, in accordance with yet another embodiment of the present disclosure.

FIG. 12 illustrates an isometric cover 102 having a reinforcing element configured on inner surface of the cover 102, in accordance with another embodiment of the present disclosure. The reinforcing element in the present embodiment is a reinforcing frame 360. The reinforcing frame 360 comprises cross members 361, 362 to enhance the structural integrity of the cover 102. The number of the cross members is not limited to two, and the reinforcing frame 360 may have any number of cross members arranged in any configuration other than that illustrated in FIG. 12. In yet another embodiment, the reinforcing frame 360 and the cross members 361, 362 may have an L-shape cross-section, a C-shape cross-section, unistrut cross-section, a square cross-section, and the like. Furthermore, the reinforcing frame 360 may either be welded or fastened to the inner surface of the cover 102. The fastening of the reinforcing frame 260 on the inner surface of the cover 102 may be done either by means of studs or screws.

Figure 13:
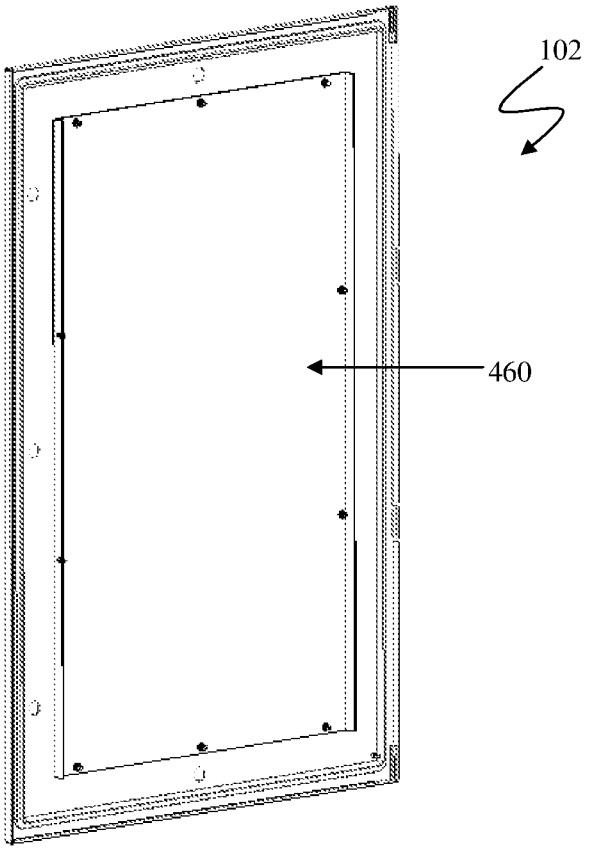
FIG. 13 illustrates an isometric view of the cover having a reinforcing element configured on inner surface of the cover, in accordance with yet another embodiment of the present disclosure.

FIG. 13 illustrates an isometric cover 102 having a reinforcing element configured on inner surface of the cover 102, in accordance with another embodiment of the present disclosure. The reinforcing element in the present embodiment is a reinforcing plate 460. The reinforcing plate 460 may either be welded or fastened to the inner surface of the cover 102. The fastening of the reinforcing frame 460 on the inner surface of the cover 102 may be done either by means of studs or screws. In the embodiment of FIG. 12, the reinforcing plate 460 has a rectangular configuration. However, the shape of the reinforcing plate 460 is not limited to being rectangular, and other configurations of the reinforcing plate 460 such as circular, triangular, elliptical, polygonal, and the like are well within the ambit of the present disclosure.

Figure 14:
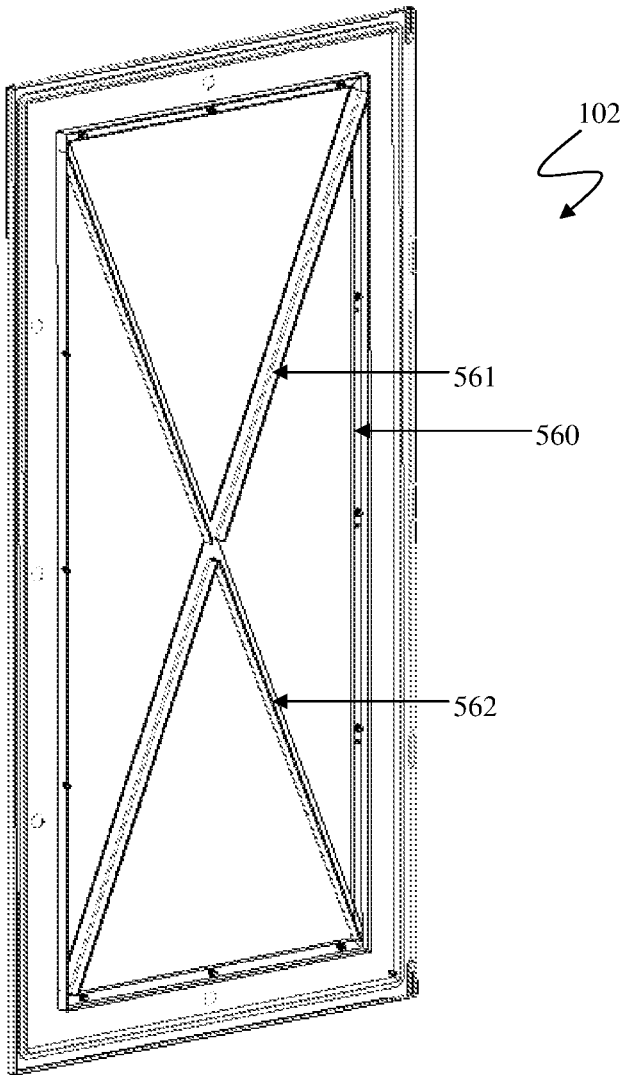
FIG. 14 illustrates an isometric view of the cover having a reinforcing element configured on inner surface of the cover, in accordance with yet another embodiment of the present disclosure.

FIG. 14 illustrates an isometric cover 102 having a reinforcing element configured on inner surface of the cover 102, in accordance with another embodiment of the present disclosure. The reinforcing element in the present embodiment is a reinforcing frame 560. The reinforcing frame 560 comprises cross members 561, 562 to enhance the structural integrity of the cover 102. In the embodiment of FIG. 14, the cross members 561, 562 are diagonal elements connected to the opposite vertices of the rectangular reinforcing frame 560. The configuration of reinforcing frame 560 may also be achieved by the use of triangular frames. The number of the cross members is not limited to two, and the reinforcing frame 560 may have any number of cross members arranged in any configuration other than that illustrated in FIG. 14. In yet another embodiment, the reinforcing frame 560 and the cross members 561, 562 may have an L-shape cross-section, a C-shape cross-section, unistrut cross-section, a square cross-section, and the like. Furthermore, the reinforcing frame 560 may either be welded or fastened to the inner surface of the cover 102. The fastening of the reinforcing frame 560 on the inner surface of the cover 102 may be done either by means of studs or screws.

TECHNICAL ADVANCEMENTS AND ECONOMIC SIGNIFICANCE

An enclosure assembly with a concealed hinge system, in accordance with the present disclosure described herein above has several technical advantages including but not limited to the realization of an enclosure assembly with a concealed hinge system:

- that does not involve the use of press fit inserts;
- that has mounting provisions for mounting a lifting eye for handling the enclosure assemblies during shipment; and
- such that vertical coupling of two or more enclosure assemblies does not cause interference of the hinges between two adjacent enclosure assemblies.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or mixture or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form part of the prior art base or were common general knowledge in the field relevant to the disclosure, as it existed anywhere before the priority date of this application.

We claim:

1. An enclosure assembly with a concealed hinge system, said enclosure assembly comprising:

a quadrilateral cabinet defined by a base and sidewalls extending from said base, said sidewalls defining a coplanar rim, said coplanar rim having four corners, said quadrilateral cabinet further defining a hollow space;

a cover configured to swivel along a first sidewall to tightly seal said hollow space;

a first pair of hinges defined by brackets welded to a first corner and a second corner of said first sidewall, said brackets defined by a first footplate and an integral ear extending from said first footplate, an aperture defined in said integral ear;

a block for each hinge in said first pair of hinges welded to an inner surface of said cover, said block defining a tapped blind hole, wherein in an operative configuration said tapped blind hole is coaxial with said aperture defined in said integral ear;

a threaded fixture for each hinge in said first pair of hinges adapted to pass through said recessed aperture and thread into said tapped blind hole, said fixture defining a head complementary to said aperture;

at least one second hinge having a second footplate welded to said coplanar rim of said first sidewall, arcuate arms extending from either end of said second footplate, said arcuate arms defining coaxial apertures, a sleeve weldable to said inner surface of said cover defining a through-hole; and a pin configured to pass through said coaxial apertures and said through-hole in an operative configuration, in which said apertures in said first pair of hinges, said tapped blind hole, said coaxial apertures defined on said arcuate arms, and said through-hole are coaxial to enable swiveling action of said cover over second, third, and fourth sidewalls to enclose said hollow space defined in said quadrilateral cabinet.

2. The enclosure assembly as claimed in claim 1, wherein said aperture is countersunk.

3. The enclosure assembly as claimed in claim 1, wherein said threaded fixture is a countersunk screw.

4. The enclosure assembly as claimed in claim 1, further comprising a seal disposed operatively between said threaded fixture and said aperture to prevent direct surface contact of said threaded fixture and said aperture.

5. The enclosure assembly as claimed in claim 1, further comprising a plurality of mounting feet welded onto said enclosure assembly to facilitate mounting of said enclosure assembly.

6. The enclosure assembly as claimed in claim 1, further comprising a plurality of latches to facilitate fastening of said cover with said quadrilateral cabinet.

7. The enclosure assembly as claimed in claim 1, wherein said cover is adapted to receive reinforcing elements on said inner surface of said cover to enhance the structural integrity of said cover.

8. The enclosure assembly as claimed in claim 7, wherein said reinforcing element is at least one of a reinforcing frame and a reinforcing plate.

9. The enclosure assembly as claimed in claim 8, wherein said reinforcing frame has at least one configuration chosen from a group consisting a rectangular configuration, a triangular configuration, and combinations thereof.

10. The enclosure assembly of claim 1, wherein the aperture is a recessed aperture.

11. The enclosure assembly of claim 1, wherein the first footplate of the bracket of the first hinge of the first pair of hinges extends horizontally and outwardly from an outside of a first corner of the enclosure assembly; and the first footplate of the bracket of the second hinge of the first pair of hinges extends horizontally and outwardly from an outside of the second corner of the enclosure assembly.

12. The enclosure assembly of claim 11, wherein the integral ear extends vertically from the first footplate of the bracket of the first hinge of the first pair of hinges, and wherein the integral ear extends vertically from the first footplate of the bracket of the second hinge of the first pair of hinges extends vertically from the first footplate of the second hinge of the first pair of hinges.

* * * * *